United States Patent [19]

De Sepio et al.

[11] 4,145,782

[45] Mar. 27, 1979

[54] DAVIT FALL RECOVERY METHOD AND SYSTEM

[75] Inventors: Dominick A. De Sepio, Ocean Grove, N.J.; Ronald W. Phillips, II, Akron, Ohio

[73] Assignees: The B. F. Goodrich Company, Akron, Ohio; Marine Safety Equipment Corp., Farmingdale, N.J.

[21] Appl. No.: 840,704

[22] Filed: Oct. 11, 1977

[51] Int. Cl.[2] ..... B63B 23/00

[52] U.S. Cl. ..... 9/30; 212/3 R; 9/34

[58] Field of Search ..... 212/3, 8, 44; 294/19 R, 294/19 A, 24; 9/30, 32, 33, 34, 35, 36, 37, 38, 39, 40

[56] References Cited

U.S. PATENT DOCUMENTS

| | | | |
|---|---|---|---|
| 2,319,854 | 5/1943 | Elling | 9/38 |
| 2,609,621 | 9/1952 | Babin | 212/44 |
| 2,986,750 | 6/1961 | Herreshoff | 9/32 |

*Primary Examiner*—Trygve M. Blix
*Assistant Examiner*—D. W. Keen
*Attorney, Agent, or Firm*—Harry F. Pepper, Jr.

[57] ABSTRACT

A raft supporting fall extends over a pulley at the end of a davit mounted on a platform. The fall hangs down from the pulley at a spaced-apart position from the edge of the platform. A recovery line in the form of a loop extends around the davit and over guides from the platform to a position near the pulley. The recovery line is connected to the fall by an extension line on the end of which is a fall retainer through which the fall passes. The fall is recovered by pulling the recovery line towards the platform with the fall having a predetermined portion hanging below the retainer so that as the fall is being pulled into the platform there is a sufficient amount of line to reach the platform.

15 Claims, 5 Drawing Figures

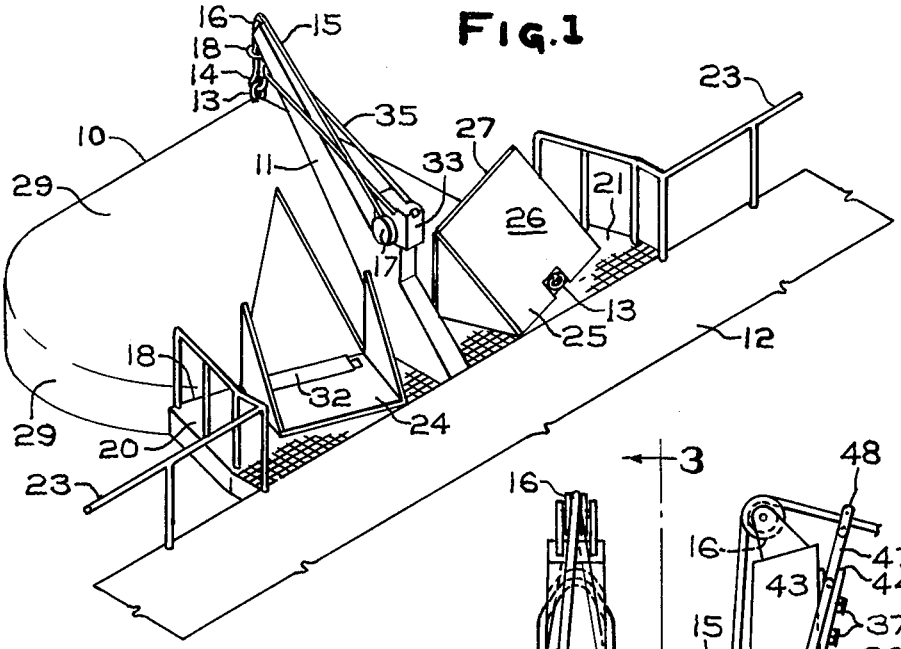
FIG. 1
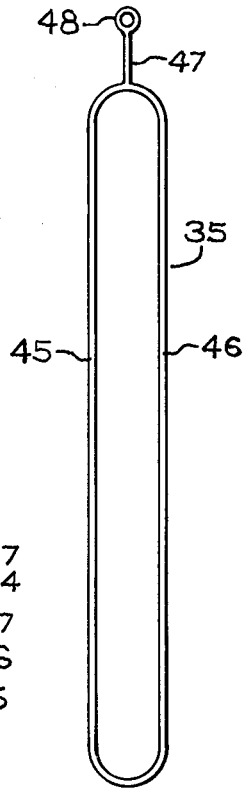
FIG. 5
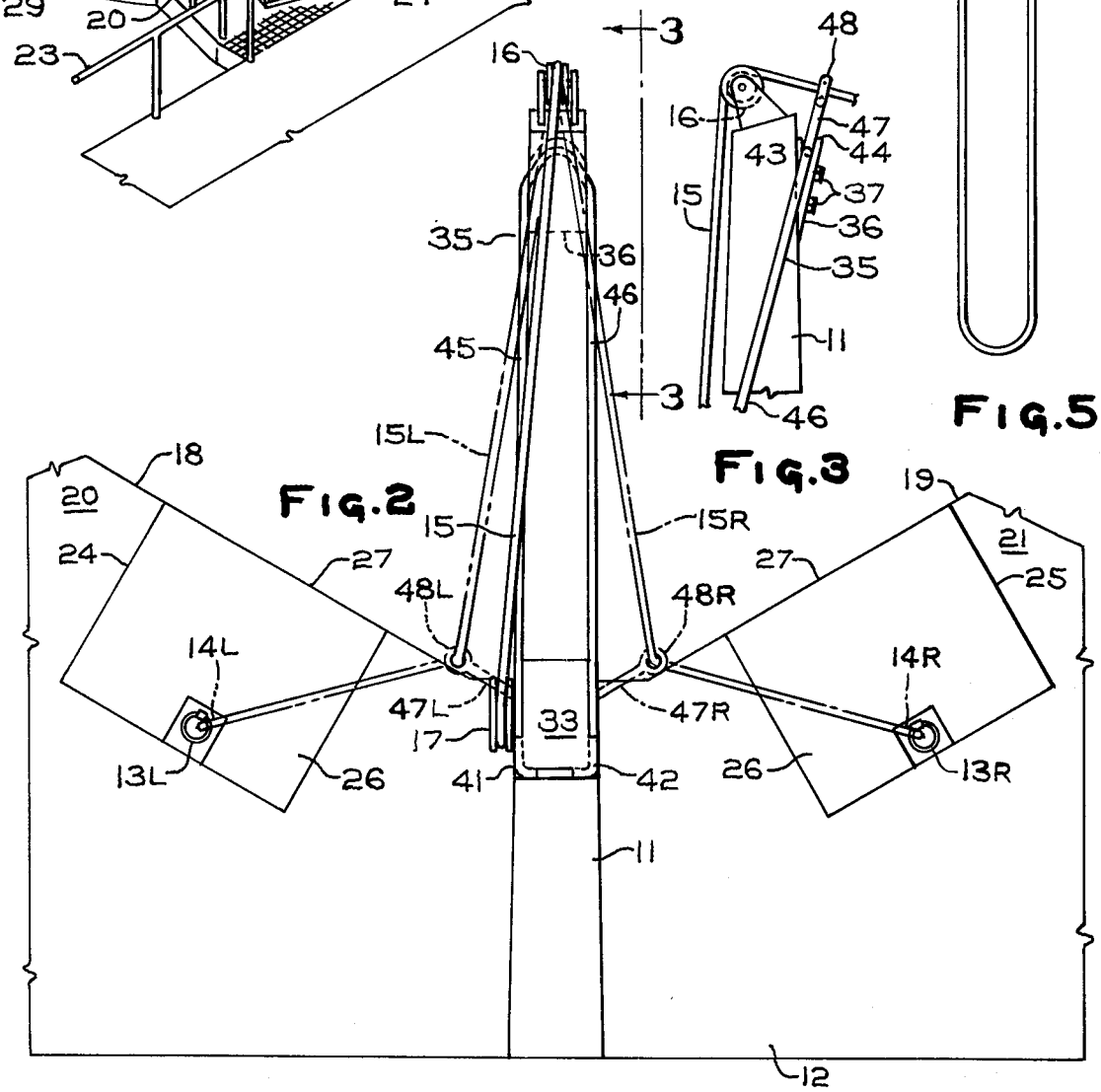
FIG. 2
FIG. 3
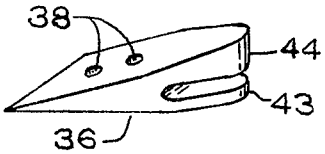
FIG. 4

DAVIT FALL RECOVERY METHOD AND SYSTEM

BACKGROUND OF THE INVENTION

This invention relates to collapsible escape equipment for passengers and especially to the supporting falls for supporting and lowering this equipment from davits mounted on an elevated platform or deck. For example, falls of this type are used to support inflatable rafts for evacuating people from offshore oil production platforms in the event of fire or other emergency. They may also be used for evacuating people from ships at sea.

It is desirable to use a fall for launching more than one raft so that after one raft has been loaded and lowered to the water the fall can be disconnected and raised to a position where it can be attached to another raft and the launching operation repeated. This is difficult to do where the fall hangs from a davit which extends outward from the edge of the deck causing the fall to be spaced out of reach of persons on the deck.

In the past, a pole with a hook on the end has been used to recover the fall; however, this has been difficult and time consuming especially in a high wind. It has also been inconvenient to recover the fall on the side of the davit where the raft is located when the wind is blowing towards the other side where the operator must stand to reach the fall. It has also been found that fastening a recovery line to the fall is not desirable because this line can become fouled during the lowering process which may pull the raft into the side of the deck structure or the side of the ship causing an upset or damage to the raft. Since time is of the essence in evacuating persons during an emergency, a system is needed which is quick and reliable as delay can cost lives.

SUMMARY OF THE INVENTION

It is a principal object of this invention to provide a system for recovering a fall hanging from a davit at a position spaced from the platform on which the davit is mounted.

Another object of this invention is to provide a recovery line slidably mounted on the davit and connected to the fall for pulling the fall into the platform.

A further object is to provide a connection between the fall and recovery line which will permit unimpeded vertical movement of the fall.

A still further object is to provide for recovery of the fall on either side of the davit.

Another object is to provide for guiding the recovery line around the outer end of the davit.

A further object is to provide an extension line for connecting the fall and the recovery line.

A still further object is to provide for moving the extension line from one side of the davit to the other side.

Another object is to provide a method of recovering a fall after it has been used for launching a raft.

A further object is to provide a method in which the fall may be recovered on either side of the davit.

A still further object is to provide for automatically returning the recovery line to the fall lowering position when a load is put on the fall.

BRIEF DESCRIPTION OF THE DRAWINGS

In the drawings:

FIG. 1 is a view in perspective of a davit mounted on a platform and having a fall recovery system embodying the invention with parts of the platform and retaining rail being broken away.

FIG. 2 is a plan view of the davit and recovery system shown in FIG. 1 after the first raft has been launched with additional rafts in both containers and parts of the platform being broken away. The fall and recovery line is shown in phantom lines in the recovered position on both sides of the davit.

FIG. 3 is a fragmentary side elevation of the end of the davit taken along the plane of line 3—3 in FIG. 2.

FIG. 4 is an enlarged view in perspective of the guide block shown in FIG. 3.

FIG. 5 is a detailed view of the recovery line for the system showing the extension line and fall retaining ring.

DETAILED DESCRIPTION

Referring to FIG. 1, a launching system for a collabsible passenger escape conveyance such as an inflatable raft 10 is shown with the raft inflated and hanging from an overhead supporting member such as the davit 11 mounted on an elevated platform 12 such as the deck of an oil rig or the deck of a ship. The davit 11 extends upwardly and away from the platform 12 so as to support the raft 10 in a position for loading. The raft 10 has a shackle 13 which is connected through a suitable quick-release hook mechanism 14 to a fall or cable 15 which extends over a pulley 16 at the end of the davit 11 to a winch 17 for raising and lowering the raft.

The platform 12 may have at least two edges 18 and 19 at an angle providing a recess adjacent the davit 11 in which the raft 10 is positioned in the inflated condition. These edges 18 and 19 are on extensions such as wing member 20 and wing member 21 of the platform 12. Retaining rails 23 may be provided along the sides of the wing members 20 and 21 and the platform 12 as shown in FIG. 1.

Containers 24 and 25 which may be identical in construction are releasably mounted on the wing members 20 and 21 by suitable means for ease of attachment to the platform 12 and ease of removal so that the containers may float free or meet the safety requirements for throwing the containers overboard.

The containers 24 and 25 have hinged sides 26 and 27 for covering and protecting the deflated raft 10 in the stored condition. The shackle 13 extends outwardly through the opening in the hinged side 26 and the shackle is attached to the hook mechanism 14 and cable 15 as shown in phantom lines in FIG. 2. When it is desirable to use the raft 10, the winch 17 is turned and the raft is pulled out of either container 24 or container 25 depending upon which one contains the raft that is connected to the cable 15 by the hook mechanism 14. At the time the raft 10 is pulled out of the container 24, a valve (not shown) for inflating the raft is actuated providing communication from a suitable source of air or gas (not shown) to the inflatable chambers of the raft. Simultaneously the hinged sides 26 and 27 are pulled away from the container 24 and downward alongside the platform 12 and wing member 20 as shown in FIG. 1. The raft 10 may also have inflatable sides 28 connected to a canopy 29 and a girt or apron 32 releasably connected to the floor of the container 24.

In loading the raft 10, the passengers step on the floor of the container 24 between the sides and over the apron 32 into the raft. When the last passenger has stepped into the raft 10, the apron 32 is released and the raft lowered on the cable 15 at a controlled rate. In the present embodiment, the winch 17 is mounted on a gear box 33 containing a brake for preventing turning of the winch during the loading operation and a governor to lower the raft at a controlled rate when the brake is released. After the apron 32 is released, the brake in gear box 33 is released and the governor lowers the raft 10 to the water. The quick-release hook mechanism 14 is then actuated and the cable 15 is disconnected from the raft at the shackle 13. The cable 15 is then raised by turning the winch 17 to a predetermined position below the davit 11.

As shown in FIGS. 1, 2 and 3, the cable 15 extends from the winch 17 over the pulley 16 mounted on the end of the davit 11 and hangs down from the pulley. A recovery line 35 of rope or cable which is relatively inextensible and is in the form of a loop, extends from the gear box 33 to the outer end of the davit 11. The recovery line 35 is supported at the outer end of the davit 11 by a line supporting member such as grooved block 36 fastened to the underside of the davit by cap-screws 37 extending through holes 38 in the block and threaded in corresponding holes in the davit. The recovery line extends through tubular guides 41 and 42 mounted on the top of the gear box 33 providing a recovery line path extending from tubular guide 42 along the right-hand side of the davit through the grooved block 36 and back along the left-hand side of the davit to tubular member 41 and then across to tubular guide 42 as shown in FIG. 2. The length of the recovery line 35 is less than the length of this recovery line path so that the recovery line will stay in substantially this path at all times. The grooved block 36 has lips 43 and 44 of sufficient length to compensate for stretching of the recovery line 35 in use.

As shown in FIGS. 2 and 5, the recovery line 35 has a first length 45 extending from the platform to the end of the davit 11 on the left side as shown in FIG. 2 and a second length 46 extending from the platform 12 to the end of the davit on the right side as shown in FIG. 2. Connected to the recovery line 35 at a position between the first length 45 and second length 46 is an extension line 47 of cable or rope which may be spliced to the recovery line. The extension line 47 is fastened to a fall retaining member such as a ring 48 having an opening through which the fall cable 15 may slide without binding. The length of the extension line 47 is substantially the same as but not less than the distance between the grooved block 36 and the cable 15. As shown in FIGS. 3 and 4, the lips 43 and 44 of the grooved block 36 are spaced apart to permit movement of the extension line 47 from one side of the davit 11 to the other.

In accordance with this invention, the recovery line 35 is mounted on the davit 11 and held in position in the recovery line path by the grooved block 36 and tubular guides 41 and 42. The cable 15 is pulled through the ring 48 over the pulley 34 and wrapped around the winch 17. In the loading position of the raft 10, the recovery line 35 is in the position shown in FIGS. 1, 2 and 3 with the ring 48 located below the pulley 16. This position is maintained when the raft 10 is lowered from the position shown in FIG. 1 to the water. After the hook mechanism 14 is released from the shackle 13, the cable 15 is raised until the hook mechanism 14 reaches a predetermined level. The operator then determines on which side of the davit 11 it is desired to recover the hook mechanism 14 and length of cable 15. If it is desired that the cable 15 indicated by the numeral 15L be recovered on the left side, the first length 45 of the recovery line 35 is grasped and pulled toward the platform 12. The extension line 47 will then be moved to a position 47L, as shown in phantom lines in FIG. 2, with the ring 48 in a position 48L. The hook mechanism 14L may then be connected to a shackle 13L of a raft in container 24. This is also the position of the raft 10 before it is pulled out of the container 24 and inflated to the condition shown in FIG. 1.

On the other hand, if it is desired to recover the cable 15 indicated by numeral 15R on the right side of the davit 11 as shown in phantom lines in FIG. 2, the second length 46 of the recovery line 35 may be grasped by the operator and pulled toward the platform 12 to a position 47R of the extension 47 connected to ring 48 at position 48R and the hook mechanism 14R connected to a shackle 13R of a raft in container 25. It will be seen that the level to which the hook mechanism 14 is raised prior to recovery of the cable 15 must not be less than the length of the cable portions 15L and 15R from the pulley 16 to the platform 12. The recovery line 35 can then be moved toward the platform a sufficient distance for the operator to grasp the hook mechanism 14 after which the cable 15 may be pulled through the ring 48 and fastened to the shackle 13 of a raft.

In the embodiment shown, after the raft 10 is lowered from the position shown in FIG. 1 and the hook mechanism 14 released from the shackle 13, the operator will raise the hook mechanism to a level as indicated above and then pull on the second length 46 of the recovery line 35 to bring the cable 15 to the right side of the davit where a raft 10 is stowed in the container 25. This raft 10 may then be pulled out of the container 25 and take the position of the raft shown in FIG. 1 in the inflated condition. Meanwhile, the container 24 may be replaced with another full container and be ready for inflation and launching after the raft 10 from container 25 is lowered to the water and disengaged from the hook mechanism 14.

It will be seen from FIG. 2 that as the raft 10 is pulled out of either container 24 or container 25 by rotating the winch 17, the ring 48 through which the cable 15 extends will be pulled toward the grooved block 36 and automatically take a position under the pulley 16 as shown in FIGS. 2 and 3. Accordingly, the recovery line 35 need not be touched by the operator after it is used to bring the cable 15 and hook mechanism 14 into the platform 12 where it can be hooked onto the shackle 13 of the raft. This is important because during the evacuation of passengers from the platform 12, the operator need only turn the winch 17 and need not manipulate the recovery line 35. Also when the cable 15 is moved vertically through the ring 48, the length of the extension line 47 is such that the ring will not bind on the cable or pull the cable any appreciable distance which could adversely affect the lowering of the raft 10.

Although two containers 24 and 25 are shown on two wing members 20 and 21, it is understood that this invention is applicable also to systems with only one container and one wing member or there may be more than two containers at more than two positions along the edge of the platform 12.

The invention is capable of other modifications and adaptions by those having ordinary skill in the art and is more particularly defined by the appended claims.

I claim:

1. A davit fall recovery system comprising a platform, a davit mounted on said platform and extending to an elevated outboard position spaced from said platform, a pulley mounted on said davit at said outboard position, a fall member extending over and hanging from said pulley, a recovery line, a recovery line supporting member mounted on said davit at a position near said pulley, said recovery line having a first length extending from said platform to said line supporting member and a second length extending from said supporting member to said platform, an extension line connected to said recovery line at a position between said first length and said second length of said recovery line, a fall retaining member on said extension for retaining and permitting movement of said fall through said retaining member, and said recovery line being slidable over said supporting member for moving said fall toward said platform by pulling said first length or said second length toward said platform.

2. A davit fall recovery system according to claim 1 wherein said recovery line is a loop and said first length and said second length are connected at the platform.

3. A davit fall recovery system according to claim 2 wherein said recovery line extends around guide means at the end of said davit in proximity to said platform.

4. A davit fall recovery system according to claim 3 wherein said guide means includes a recovery line slide member for retaining the line and guiding it from one direction to an opposite direction.

5. A davit fall recovery system according to claim 2 wherein said guide means is supported by said davit.

6. A davit fall recovery system according to claim 1 wherein said recovery line supporting member includes a grooved block mounted on the underside of said davit.

7. A davit fall recovery system according to claim 1 wherein said fall retaining member is a ring through which said fall member extends.

8. A davit fall recovery system according to claim 1 wherein the length of said extension line is at least as great as the distance between said recovery line supporting member and said fall member.

9. A davit fall recovery system according to claim 8 wherein said extension line is spliced to said recovery line.

10. A davit fall recovery system according to claim 1 wherein said recovery line supporting member is open to permit movement of said extension line through said member from one side of said davit to the other.

11. A davit fall recovery system according to claim 10 wherein the length of said recovery line is not greater than the length of the recovery line path between said recovery line supporting member and said guide means so that said recovery line will remain in said path.

12. A davit fall recovery system according to claim 1 wherein said fall member has a release hook on the portion hanging from said pulley for releasable connection with a life raft or other supported body.

13. A method of recovering a fall member extending over and hanging from a pulley on one end of a davit by movement of a portion of said fall member to a position adjacent the other end of said davit comprising extending said fall through a retaining member positioned below said pulley and connected to a recovery line extending from a position in the proximity of said one end of said davit to a position in the proximity of the other end of said davit, providing a predetermined length of said fall member below said retaining member, and pulling said recovery line toward said other end of said davit while permitting a portion of said length hanging below said retaining member to move through said retaining member.

14. The method of recovering a fall member according to claim 13 wherein said recovery member is in the form of a loop around said davit and said fall member is moved to a position on the desired side of said davit by pulling the portion of said loop on that side of said davit.

15. The method of recovering a fall member according to claim 13 wherein said retaining member is connected to said recovery line by a flexible extension permitting vertical movement of said fall member through said retaining member when said retaining member is positioned below said pulley and automatically returning said retaining member to the position below said pulley when said fall member is pulled toward said pulley to launch a life saving raft.

* * * * *